United States Patent [19]

Nakajima et al.

[11] 4,327,797

[45] May 4, 1982

[54] HORIZONTAL TYPE BLIND

[75] Inventors: Yukihiko Nakajima, Ohmi hachiman; Mitsuru Ohkubo, Chofu; Tadakatsu Hashimoto; Shigeki Nakamura, both of Yokkaichi, all of Japan

[73] Assignee: Kabushiki Kaisha Yokota, Tokyo, Japan

[21] Appl. No.: 77,414

[22] Filed: Sep. 20, 1979

[30] Foreign Application Priority Data

Jan. 22, 1979 [JP] Japan ..... 54-00481
Jan. 22, 1979 [JP] Japan ..... 54-005072[U]
Jan. 25, 1979 [JP] Japan ..... 54-007162[U]

[51] Int. Cl.[3] ..... E06B 9/322
[52] U.S. Cl. ..... 160/168 R; 160/178 C
[58] Field of Search ..... 160/168, 167, 178 C; 16/205

[56] References Cited

U.S. PATENT DOCUMENTS 1,993,173 3/1935 Kuyper ..... 160/168
2,017,541 10/1935 Kuyper ..... 160/168
2,091,032 8/1937 Dodge ..... 160/168
2,172,657 9/1939 Haase ..... 160/178 C
4,180,118 12/1979 Vecchiarelli ..... 160/178 C

FOREIGN PATENT DOCUMENTS 153509 2/1952 Australia ..... 160/178 C

*Primary Examiner*—Philip C. Kannan
*Attorney, Agent, or Firm*—Blanchard, Flynn, Thiel, Boutell & Tanis

[57] ABSTRACT

A horizontal type blind having a novel mechanism for opening and closing slats which includes a pair of drive shafts juxtaposed in a housing fixed to a head box and adapted to be rotated in the same direction by pulling a slats-opening and closing cord and a pair of rollers connected to the drive shafts respectively and having two straps for holding the slats wound therearound respectively so as to feed either one of the straps while taking up the other according to the rotation of the rollers.

1 Claim, 6 Drawing Figures

HORIZONTAL TYPE BLIND

TECHNICAL FIELD OF THE INVENTION

This invention relates to a horizontal type blind comprised of a plurality of horizontal slats, and more particularly to a horizontal type blind having a novel structure for opening and closing the slats. The slat opening and closing structure may advantageously be employed in combination with a specific structure for raising and lowering slats.

BACKGROUND OF THE INVENTION

In a known horizontal type blind, a mechanism for opening and closing slats comprises one drive shaft provided in a head box and rotatable by operating an opening and closing cord, a roller fixed to the drive shaft, and two straps for holding side ends of the slats and wound around the roller in such a manner that either on of the straps is fed while the other is taken up according to the rotation of the roller by the opening and closing cord. A mechanism for raising and lowering the slats comprises a roller provided in the head box, extending in a direction perpendicular to the length of the head box and a raising and lowering cord guided through the roller for raising or lowering the slats by the operation of the cord. Since the rollers for opening and closing the slats and for raising and lowering the slats, respectively, are integrally encased in a housing and disposed perpendicularly with each other, their diameters are restricted and cannot be determined freely. In general, to attain accurate opening and closing of the slats and smooth raising and lowering thereof, it is required that the distance between the two hanging straps for holding the slats be small and the diameter of the roller for guiding the raising and lowering cord be large. However, the known mechanism for opening and closing the slats and mechanism for raising and lowering the slats as mentioned above cannot have a structure satisfying the aforesaid requirements. Therefore, the known mechanisms inevitably suffer from defects that the slats are not closed completely and that a considerably large force is required to raise and lower the slats.

SUMMARY OF THE INVENTION

It is therefore an object of the present invention to provide a horizontal type blind having a slats-opening and closing mechanism which is capable of reducing the distance between straps holding the slats therebetween so that the slats may be closed completely. The slats-opening and closing mechanism allows employment of a pulley of large diameter for guiding a slats-raising and lowering cord.

According to the present invention, there is provided a horizontal type blind having mechanisms for raising and lowering slats by operating a slats-raising and lowering cord and for opening and closing the slats by operating a slats-opening and closing cord, which blind is characterized by a pair of drive shafts juxtaposed in a housing fixed to a head box and adapted to be rotated in the same direction by the slats-opening and closing cord; and a pair of rollers connected to said drive shafts respectively and having two straps for holding the slats therebetween wound therearound in opposite directions.

DESCRIPTION OF PREFERRED EMBODIMENT

Figure 2:
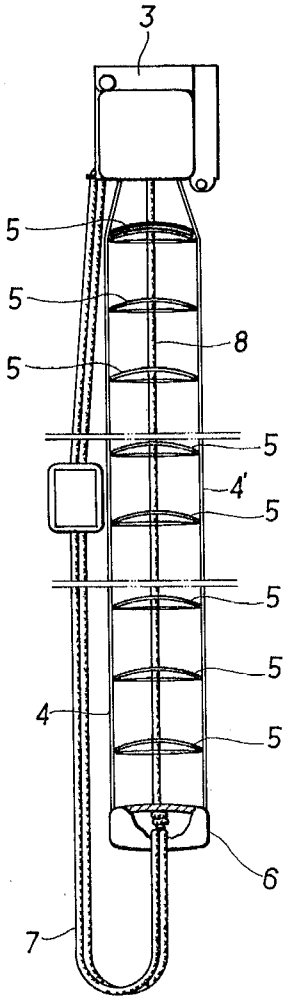
FIG. 2 is a side view of the blind illustrated in FIG. 1.
Figure 1:
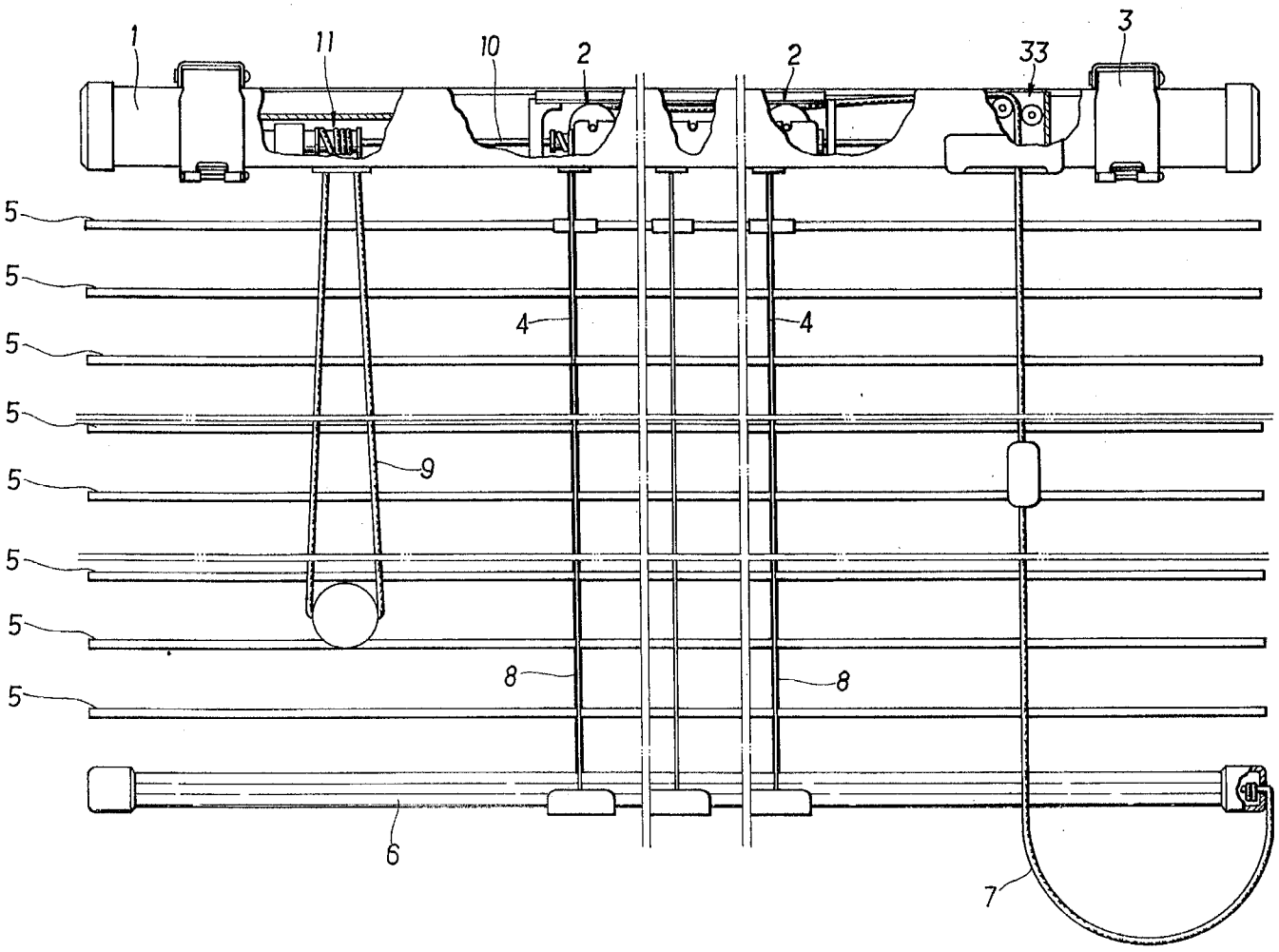
FIG. 1 is an elevational view of a horizontal type blind according to the present invention.

Referring now to the drawings, there is illustrated a preferred embodiment of the present invention. FIGS. 1 and 2 are partly cut out elevational and side elevational views, respectively, of a horizontal type blind employing slats-opening and closing mechanisms and slats-raising and lowering mechanisms in accordance with the present invention. The blind has a head box 1 to be fixed to a window frame etc. by a fixture 3. Assemblies of the mechanisms for opening and closing slats and for raising and lowering them are generally designated by numeral 2 in FIG. 1 and disposed at a suitable position in the head box 1. Each of the assemblies 2 has two straps 4, 4' hanging down therefrom. A plurality of slats 5 are held at their respective ends by the straps 4, 4' so as to be suspended in positions respectively. A bottom rail 6 is held at the lowermost position of the blind. Two operating cords 7 for raising and lowering the slats 5 extend downwardly from the right lower end portion of the head box 1 in the embodiment illustrated. The operating cords 7 extend to the assemblies 2 through the head box 1 and have portions 8 which extend downwardly to suspend the bottom rail 6. Thus, it will be seen that when the operating cord at the right end portion of the blind is pulled, the bottom rail 6 is drawn upwardly by the cord 8 and the slats 5 are drawn together upwardly. On the other hand, the drawn up slats are lowered to positions as illustrated in FIG. 1 by the operation of the operating cord 7.

At the left end portion of the head box 1, a cord 9 is extended from a drive mechanism 11, forming a loop as depicted in FIG. 1, for opening or closing the slats 5 through the straps 4, 4' extending from each of the assemblies 2. When the cord 9 is operated, a pair of drive shafts 10 juxtaposed along the length of the head box 1 and extended from the drive mechanism 11 are rotated in the same direction by the drive mechanism 11 and rollers 15, 15' on the respective drive shafts are conjointly rotated to open or close the slats 5.

Figure 4:
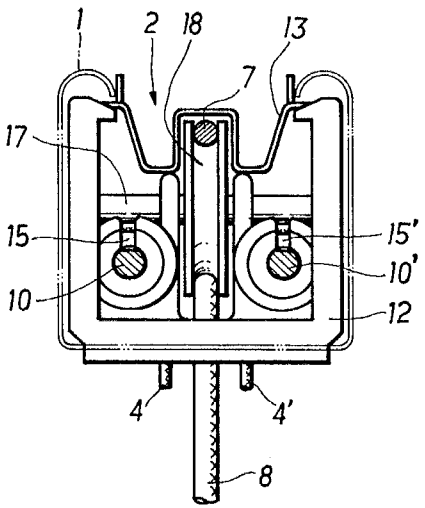
FIG. 4 is a side elevational view of the assembly illustrated in FIG. 3.
Figure 3:
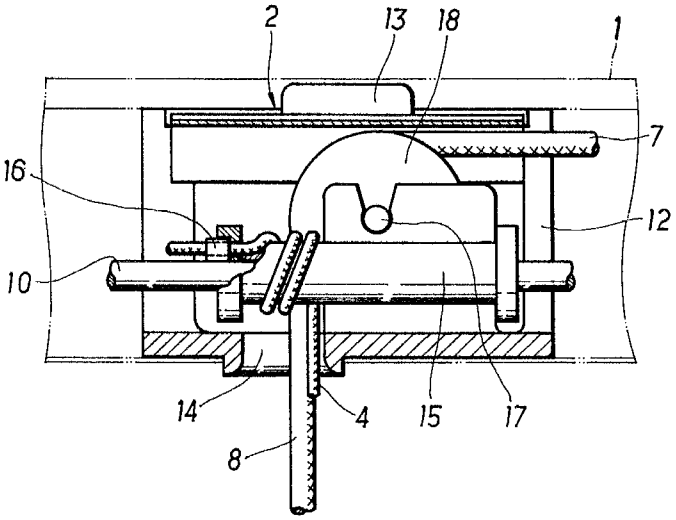
FIG. 3 is a longitudinal sectional view of an assembly of a mechanism for opening and closing slats and a mechanism for raising and lowering slats.

The detailed structure of the assembly 2 is illustrated, in longitudinal section, in FIG. 3 and, in cross section, in FIG. 4. The assembly 2 is mounted through a housing 12 in the head box 1 which housing opens at the top thereof and fixed to the head box 1 by fitting a fixing member 13 into a bent portion of the upper side portion of the head box 1. The housing 12 has an opening 14 at the bottom thereof. The cord portion 8 and the two straps 4, 4' extends downwardly through the opening 14. The straps 4, 4 are wound, in opposite directions, around the rollers 15, 15' which are juxtaposed in the housing 12 keeping a suitable distance therebetween. The upper end portions of the respective straps 4, 4' are fixed to the flange portions of the rollers 15, 15' by fixing members 16 respectively. The rollers 15, 15' are fixed to the drive shafts 10, 10' respectively and adapted to be rotated clockwise or counterclockwise according to the rotation of the drive shafts 10, 10' so that one of the straps 4, 4' may be fed while the other being taken up. As a result, the slats 5 are rotated to open or close the blind.

Thus, it will be appreciated that in the present invention a pair of rollers 15, 15' adapted to be rotated by the drive shafts 10, 10' are employed with advantages to operate the straps 4, 4'. This two-shaft drive system allows the distance between the straps 4, 4' to be reduced and enables complete light shutting in the closed position of the slats 5 as will be explained in detail later.

As further illustrated in FIGS. 3 and 4, a pulley 18 is rotatably supported by a shaft 17 which extends in a direction perpendicular to the drive shafts 10, 10' in the housing 12 of the assembly 2. The cord 7 is guided through the pulley 18 and the portion 8 thereof extends downwardly from the head box 1 through the opening 14 of the housing 12. The pulley 18 is interposed between the rollers 15, 15' and not obstructed by the rollers 15, 15', so that the diameter of the pulley 18 may be as large as the sizes of the housing 12 and the head box 1 allow. Therefore, the cord portion 8 can be pulled up with a large radius of rotation and the force required for operating the cord 7 is reduced so that the slats-raising and lowering operation can be effected smoothly. Thus, the pulley 18 can have a sufficiently large diameter due to the specific two-shaft drive system for opening and closing the slats 5 as mentioned above.

Figure 5:
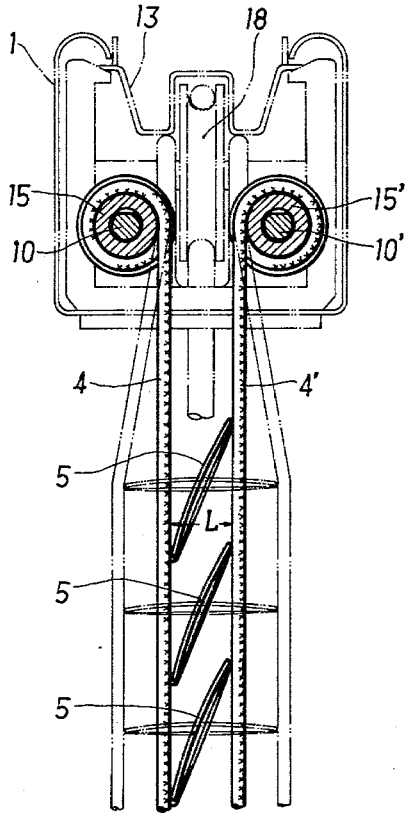
FIG. 5 is an explanatory view illustrating the slats opening and closing operation by the mechanism for opening and closing slats illustrated in FIG. 3.

FIG. 5 illustrates the slats-opening and closing operation in accordance with the present invention, wherein the slats 5 are opened or closed by the feeding and taking up of the straps 4, 4' through the rollers 15, 15'. The juxtaposed arrangement of the rollers 15, 15', namely, two-shaft drive system allows the distance L between the straps 4, 4' to be reduced as compared with the known one-shaft drive system. As a result, when the slats 5 are closed, the overlapping gap between the slats 5 is narrowed so that the light shutting effect in the closed position can be improved. The distance L may be reduced to a distance as small as the width of the pulley 18. In this case, the slats 5 may be held substantially vertical in their closed positions.

Figure 6:
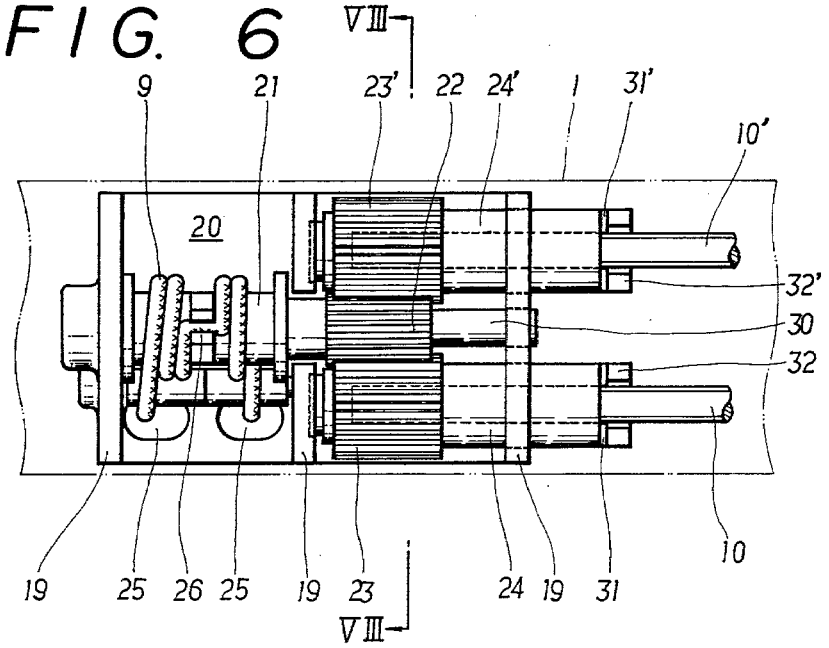
FIG. 6 is a plan view of one form of a driving mechanism for opening and closing slats.
Figure 7:
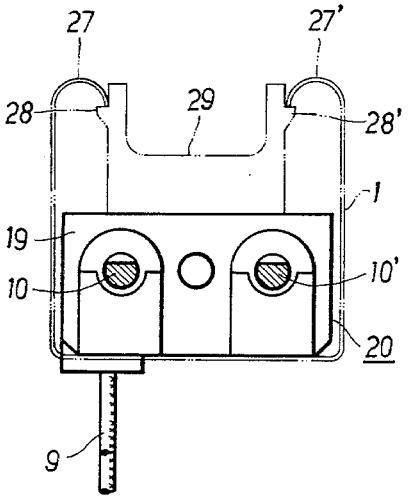
FIG. 7 is a side elevational view of the mechanism illustrated in FIG. 6.

The driving mechanism 11 for opening and closing the slats 5 employable in the present invention will now be explained in detail referring to FIGS. 6 to 8. FIG. 6 is a plan view of one preferred form of the drive mechanism 11 and FIG. 7 is a side elevational view of the same. A housing 20 has three bearing portions 19, and a driving gear 22 formed integrally with a drum shaft portion 21 around which the cord 9 is wound. The driving gear 22 is rotatably supported by a shaft 30 in the housing 20. Follower gears 23, 23' are rotatably provided on opposite sides of the driving gear 22 so as to mesh therewith. The follower gears 23, 23' have shaft portions 24, 24' respectively. The drive shaft 10, 10' are fitted in and fixed to the shaft portions 24, 24' respectively. The housing 20 further has openings 25 at positions under the drum shaft portion 21 for extending the cord 9 therethrough. The cord 9 wound around the drum shaft portion 21 is engaged at a central portion thereof with a groove 26. Therefore, the drum shaft portion 21 is rotatable in either direction, uponpulling of the cord 9, by the number of rotations corresponding to the length of the cord 9 wound around the portion 21 at either side of the groove 26. The housing 20 is fixed to the head box 1 by a fixing member 29 which has projections 28, 28' engageable with bent portions 27, 27' of the head box 1, respectively.

Figure 8:
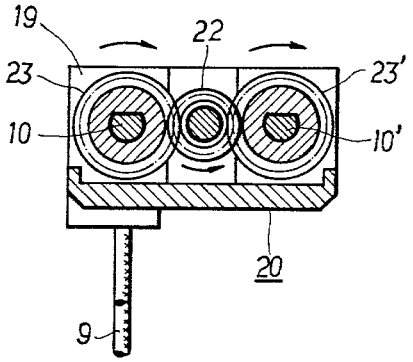
FIG. 8 is an explanatory view of the mechanism taken along a line VIII—VIII of FIG. 6, showing the meshing of gears.

FIG. 8 is a sectional view taken along a line VIII—VIII of FIG. 6, showing the engagements between the driving gear 22 and the follower gear 23, 23'. When the cord 9 is pulled in one direction to rotate the driving gear 22 for example in a direction as indicated by an arrow, the follower gears 23, 23' in mesh therewith are rotated in the same direction as designated by arrows. The drive shafts connected to the follower gears 23, 23' respectively are also rotated in the same direction.

The driving mechanism 11 is assembled as follows. The drum shaft portion 21 and the driving gear 22 are formed integrally with each other as mentioned above and the shaft 30 are inserted from the left as viewed in FIG. 6 into them arranged illustrated in the figure. The follower gears 23, 23' are formed integrally with the shaft portions 24, 24' respectively. The drive shafts 10, 10' are inserted from the right into them respectively in positions where the leftward ends thereof are received by the bearing portion 19 and collars 31, 31' are disposed around the shaft portions 17, 17' between the bearing portion 19 and the stoppers 32, 32'. Thus, the driving mechanism 11 can be fabricated separately from the head box 1 before it is mounted therein.

In general, a horizontal type blind has a means for stopping the raising and lowering of slats, namely, a slats-suspension means. In a known stopping means, a swingable lever having a claw at its tip end is provided inside of a bent portion of a cord for raising and lowering the slats, which cord extends longitudinally in a head box and is bent downwardly therefrom. When the cord is pulled laterally so as to engage the claw with the cord and then loosed to let the cord be drawn up by the weight of the slats, the lever rotates upwardly to engage the cord between the guide rollers. Thus, the lowering of the slats are stopped and the slats are suspended at a desired height. This means, however, has such disadvantages that the cord is subject to damage or wear because the claw bites into the cord to rotate the lever for stopping the cord, and that the stopping operation is not always attained surely and accurately because the operation for engaging the cord with the lever requires a skill.

Therefore, in a preferred mode of the blind in accordance with the present invention, there is employed an improved means for stopping the raising and lowering of the slats, which is capable of eliminating a damage or wear due to biting by the claw and which can afford an excellent operability with a simple structure. The means is generally designated by numeral 33 in FIG. 1 which is provided in the head box 1. The operating cord 7 is extended from the means 33.

Figure 9:
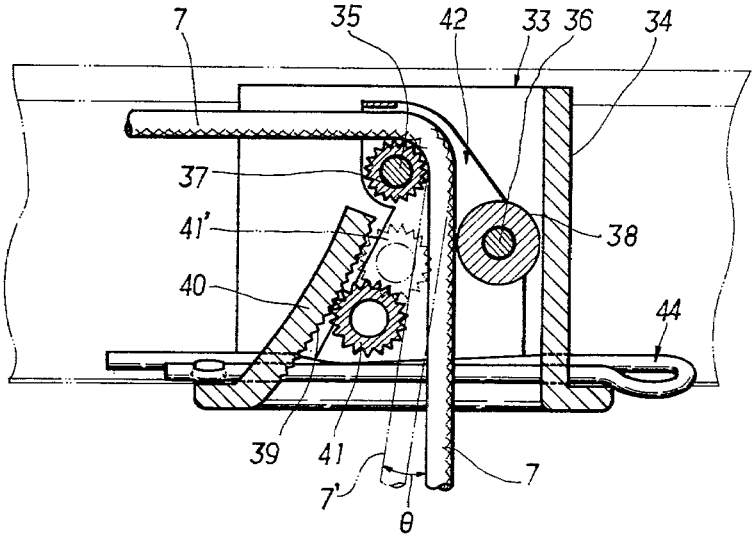
FIG. 9 is an explanatory view of one form of a mechanism for stopping the raising and lowering of the slats, taken along a longitudinal axis of a head box.
Figure 10:
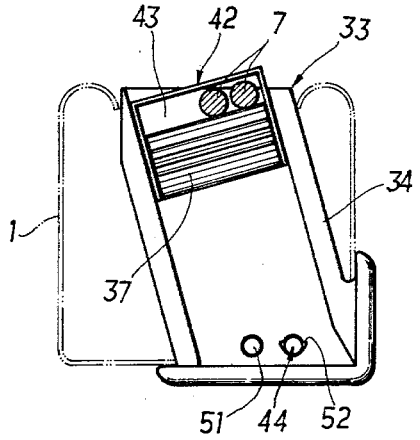
FIG. 10 is a side elevational view of the mechanism illustrated in FIG. 9.

FIG. 9 illustrates one preferred form of the means 33 for stopping the raising and lowering of the slats 5 in section taken along the length of the head box 1 and FIG. 10 illustrates the side elevation thereof. The means 33 has a housing 34 which opens at its top, bottom and left side wall. The operating cord 7 extends in the head box 1 in the longitudinal direction thereof and then drawn out downwardly by means of a toothed roller 37 and a pinch roller 38 fixed to rotatable shafts 35 and 36, respectively. The housing 34 has a slanting shape extending leftwardly upwardly as viewed in FIG. 10 and has a guide plate 40 formed integrally with the housing 34 and having a toothed face 39 on the side thereof confronting the operating cord 7 extending downwardly. In a space of inverted V-shape defined by the guide plate 40 and the operating cord 7 extending downwardly is disposed a toothed roller 41. Between the sides of the rollers 37, 38 and 41 and the inner face of the housing 34 is disposed a roller plate 42. This roller plate 42 enables smooth movement of the toothed roller 41 within the inverted V-shaped space and defines an opening 43 for extending the operating cord 7 therethrough in the longitudinal direction of the head box 1. The housing 34 is fixed to the head box 1 by a split pin 44. More particularly, the housing 34 is put into the head box 1 through an opening formed at a lower corner portion of the head box 1 as illustrated in FIG. 10 and the split pin 44 is then inserted through the housing 34. Thus, the housing 34 may be mounted after the means for suspending the slats at a desired height has been fabricated. The roller 41 is freely movable within the V-shaped space defined by the guide plate 40 and operating cord 7, and is prevented from dropping through the bottom of the housing 34 after it is released from binding engagement with the cord 7 by the split pin 44.

FIGS. 11, 12, 13 and 14 illustrate principal components of the means illustrated in FIGS. 1 and 10.

Figure 11:
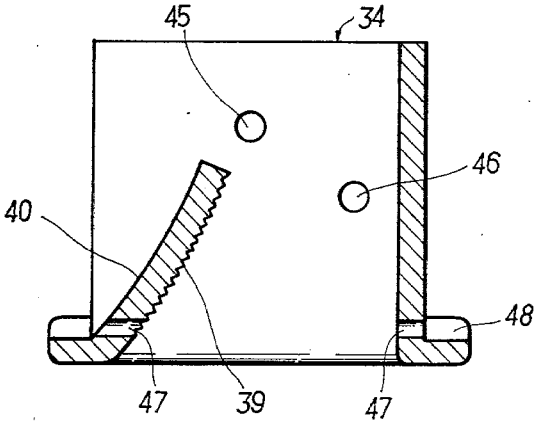
FIGS. 11 and 12 are sectional and side elevational views of a housing employable in the mechanism illustrated in FIG. 9, respectively.
Figure 12:
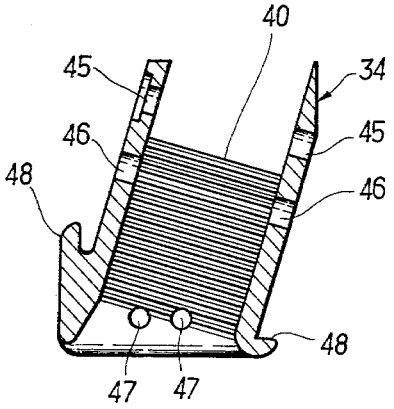
Figure 13:
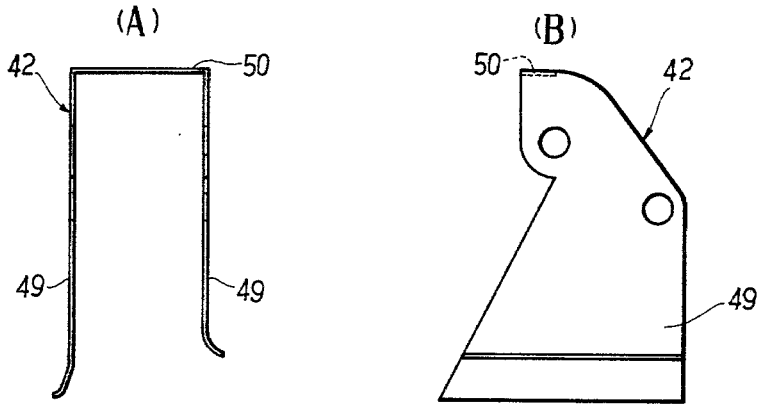
FIGS. 13A and 13B are respectively front elevational and side elevational views of a roller plate employable in the mechanism illustrated in FIG. 9.
Figure 14:
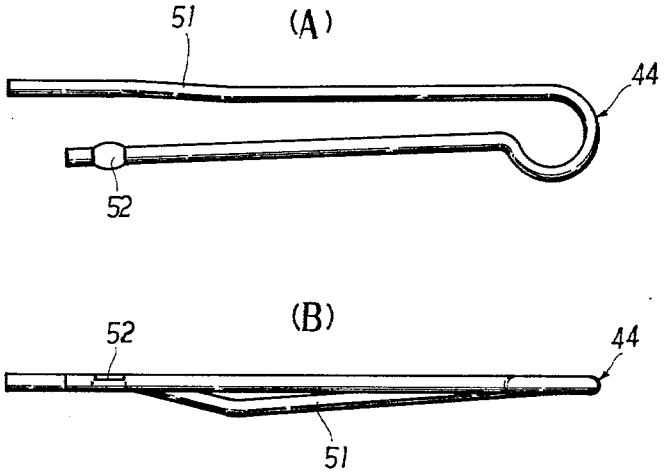
FIGS. 14A and 14B are respectively plan and side elevational views of a split pin employable in the mechanism illustrated in FIG. 9.

FIGS. 11 and 12 illustrate the housing 34 which further has shaft holes 45 and 46, pin holes 47 through which the split pin 44 is inserted and a flange 48 formed integrally therewith for receiving the lower corner portion of the head box 1.

FIGS. 13(A) and 13(B) illustrate the roller plate 42 which has side walls 49 fitted in the housing 34 as illustrated in FIG. 11 and a bridge portion 50 defining the opening 43. The inner face of the roller plate 42 has a buffed mirror surface.

FIGS. 14(A) and 14(B) illustrate the split pin 44 which has a resilient bent portion 51 for pressing the housing 34 against the head box 1 and a stopper 52 formed integrally therewith for preventing the split pin 44 from being slipped out from the housing 34.

The way the operating cord 7 is stopped will now be described referring to FIG. 9.

The figure illustrates the state where the slats are raised by pulling the operating cord 7. The toothed roller 41 is at its lower position so that the operating cord 7 can be freely pulled downwardly without any obstruction.

In order to stop and hold the slats 5 at a desired height, the operating cord 7 is deflected leftwardly to a position indicated by 7' and then let loose. The operating cord 7' is then drawn up by the weight of the bottom rail 6 and the slats 5. At that time, the operating cord 7' engages the toothed roller 41 with the toothed face 39 of the guide plate 40 and the toothed roller 41 is rotated by the operating cord 7' being raised. Consequently, the toothed roller 41 is rolled up on the toothed face 39 of the guide plate 40 and brought into a position indicated by 41', holding the operating cord 7 between the roller 41 and the pinch roller 38 so that the slats are prevented from being lowered and kept at the desired height. To assure positive rolling of the toothed roller 41, the guide plate 40 may have a curved face convexed on the side of the toothed face as illustrated. In this case, the deflecting angle $\theta$ of the operating cord can be as small as 10° or so to attain positive catch of the cord 7.

When it is desired to release the operating cord 7 held in a certain height, the operating cord 7 is pulled. Then, the toothed roller in the position 41' falls so that the slats 5 can be raised or lowered without any obstruction. To assist holding of the operating cord 7 by the toothed roller 41, the roller 37 may also be toothed as illustrated.

The embodiments of the invention in which an exclusive property or privilege is claimed are defined as follows:

1. A venetian blind, comprising a head box, a plurality of horizontal slats suspended below said head box by at least one pair of spaced straps, means cooperable with said straps for tilting said slats, a manually operable control cord, means responsive to operation of said control cord for raising and lowering said slats, and means for stopping lowering of the slats, said stopping means including a rotatably supported guide roller for guiding downwardly said control cord which extends lengthwise within said head box, a guide member disposed inside a corner formed by said control cord guided by said guide roller so as to extend slantingly upwardly and having a toothed surface thereon facing the portion of said control cord guided downwardly, a toothed roller loosely fitted in a gap of inverted V-shape defined by said surface of said guide member and the portion of said control cord extending downwardly, and a pinch roller rotatably supported on said guide member on the side of said control cord opposite said surface and said toothed roller.

* * * * *

UNITED STATES PATENT AND TRADEMARK OFFICE

CERTIFICATE OF CORRECTION

PATENT NO. : 4 327 797

DATED : May 4, 1982

INVENTOR(S) : Yukihiko Nakajima et al

It is certified that error appears in the above—identified patent and that said Letters Patent is hereby corrected as shown below:

Item [30] "Foreign Application Priority Data"; change the first item thereunder to read as follows:

---Jan. 22, 1979 [JP].....54-004813---.

Signed and Sealed this

*Seventeenth* Day of *August 1982*

[SEAL]

*Attest:*

GERALD J. MOSSINGHOFF

*Attesting Officer*

*Commissioner of Patents and Trademarks*